US006716052B2

(12) United States Patent
Kane

(10) Patent No.: US 6,716,052 B2
(45) Date of Patent: Apr. 6, 2004

(54) CONNECTOR POSITION ASSURANCE DEVICE AND LATCH

(75) Inventor: Vincent Michael Kane, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/081,198

(22) Filed: Feb. 21, 2002

(65) Prior Publication Data

US 2003/0157825 A1 Aug. 21, 2003

(51) Int. Cl.[7] ..... H01R 13/624
(52) U.S. Cl. ..... 439/352; 439/489; 439/752
(58) Field of Search ..... 439/352, 353, 439/356, 357, 358, 488, 489, 752

(56) References Cited

U.S. PATENT DOCUMENTS 4,708,413 A * 11/1987 Schroeder ..... 439/358
4,946,395 A * 8/1990 Cope et al. ..... 439/352
5,378,168 A * 1/1995 Sumida ..... 439/358
5,529,507 A * 6/1996 Felix et al. ..... 439/188
5,628,648 A * 5/1997 Higgins, Jr. et al. ..... 439/489
5,643,003 A * 7/1997 Myer et al. ..... 439/352
5,651,689 A * 7/1997 Pliler et al. ..... 439/352
5,720,623 A * 2/1998 Polenick et al. ..... 439/352
5,759,058 A * 6/1998 Childs et al. ..... 439/352
5,775,930 A * 7/1998 Model et al. ..... 439/352
5,823,814 A * 10/1998 Alwine ..... 439/352
5,910,027 A * 6/1999 Wayt et al. ..... 439/489
5,967,809 A * 10/1999 Fink et al. ..... 439/157
6,116,938 A * 9/2000 Myer et al. ..... 439/353
6,210,186 B1 * 4/2001 Fink et al. ..... 439/157
6,234,826 B1 5/2001 Wilber et al. ..... 439/352
6,250,943 B1 * 6/2001 Castle et al. ..... 439/352
6,261,115 B1 * 7/2001 Pederson ..... 439/352
6,276,953 B1 * 8/2001 Gauker et al. ..... 439/352
6,290,539 B1 * 9/2001 Wilber et al. ..... 439/595
6,354,860 B1 * 3/2002 Miller et al. ..... 439/352
6,514,098 B2 2/2003 Marpoe, Jr. et al. ..... 439/352

* cited by examiner

*Primary Examiner*—Tho D. Ta
*Assistant Examiner*—Larisa Tsukerman

(57) ABSTRACT

An electrical connector assembly is provided including a CPA, a first connector housing, a second connector housing, a retention assembly, and a CPA mounting assembly. The CPA includes a retention assembly biasing element. A retention assembly is mounted to at least one of the first and second connector housings to maintain the first and second connector housings in contact when they are mated. The retention assembly includes a removal element, and is movable between a locked and unlocked position responsive to contact between the retention assembly biasing element of the CPA and the removal element. At least one of the first and second connector housings has a CPA mounting assembly mounted thereto. The CPA is slidably mounted to the CPA mounting assembly and is movable to first, second, and third positions. In its first position, the CPA permits engagement of the first and second connector housings. In its second position, the CPA prevents engagement and disengagement of the first and second connector housings. In its third position, the CPA biases at least a part of the retention assembly and permits disengagement of the first and second connector housings.

22 Claims, 14 Drawing Sheets

CONNECTOR POSITION ASSURANCE DEVICE AND LATCH

BACKGROUND OF THE INVENTION

Certain embodiments of the present invention generally relate to a connector position assurance device (CPA) and latch for use with electrical connector housings, and an electrical connector system having a connector position assurance device (CPA) and latch.

Electrical connectors have been proposed that utilize a latch or retention assembly to maintain connector halves in a fully mated position, along with a CPA. When the connector halves are mated and the latch or retention assembly is positioned to maintain contact between the connector halves, the CPA is moved to a position that indicates the connector halves are properly connected. Thus, the CPA provides a means to assure that the connector halves are fully mated.

Conventional connector assemblies using CPAs and latches suffer from a number of drawbacks, however. Use of a latch and a CPA can require additional space, which is at a premium in many applications. The latch must be biased to disengage connector halves after they have been mated. It can be difficult to access and/or actuate the latch during disengagement of connector halves, adding to the time and difficulty of disengagement. Further, intricate CPA and latch assemblies can be difficult and expensive to manufacture. Moreover, conventional assemblies provide inadequate control of the biasing of the latch or retention assembly during the un-mating of connector halves. This lack of control can cause an over-biasing of latches or retention assemblies during the un-mating of connector halves, resulting in damage.

A connector is needed with an improved CPA and latch configuration that overcomes the above-noted and other disadvantages of conventional connectors.

BRIEF SUMMARY OF THE INVENTION

At least one embodiment of the present invention is provided including an electrical connector assembly comprising a CPA, a first connector housing, a second connector housing, a retention assembly, and a CPA mounting assembly. The CPA includes a retention assembly biasing element. The first connector housing has a body section with a mating interface on one end, and the second connector housing has an opening to receive the mating interface of the first connector housing. A retention assembly is mounted to at least one of the first and second connector housings to maintain the first and second connector housings in contact when they are mated. The retention assembly includes a removal element. The retention assembly is movable between a locked and unlocked position responsive to contact between the retention assembly biasing element of the CPA and the removal element.

At least one of the first and second connector housings has a CPA mounting assembly mounted thereto. The CPA is slidably mounted to the CPA mounting assembly and is movable to first, second, and third positions. In its first position, the CPA permits engagement of the first and second connector housings. In its second position, the CPA prevents engagement and disengagement of the first and second connector housings. In its third position, the CPA biases at least a part of the retention assembly and permits disengagement of the first and second connector housings.

Additionally, the CPA may include a mating facilitation surface. When the retention assembly is in the unlocked position and the CPA is at a fourth position between the first and second positions, the mating facilitation surface contacts the retention assembly and urges the first and second connector housings into contact.

At least one embodiment of the present invention provides an electrical connector comprising a CPA, a plug housing, a header housing, a latch, a latch retention assembly, and a CPA mounting assembly. The CPA includes a latch biasing element. The plug housing has a body section with a mating interface on one end, and the mating interface includes at least one receptacle. The header housing includes walls defining an opening to receive the mating interface. The header housing also includes at least one pin to mate with the at least one receptacle of the plug housing.

A latch is mounted to at least one of the plug and header housings for maintaining the housings in contact when mated. The latch includes a latching surface and a removal feature. One end of the latch is deflectably movable between a latched position and an unlatched position responsive to contact between the latch biasing element of the CPA and the removal feature. A latch retention assembly is mounted to at least one of the plug and header housings, and includes a latch retention feature. The latch retention feature cooperates with the latching surface of the latch to prevent the separation of the plug and header housings when they are mated and the latch is in the latched position.

A CPA mounting assembly is mounted to at least one of the plug and header housings. The CPA is slidably mounted to the, CPA mounting assembly and movable to mate, locked, and unmate positions. The CPA permits engagement of the plug and header housings when in the mate position. The CPA prevents engagement and disengagement of the plug and header housings when in the locked position. In the unmate position, the CPA deflects at least part of the latch and moves the latch to the unlatched position, thereby permitting disengagement of the plug and header housings.

The plug housing may further include a shroud extending about at least a portion of the body section. The shroud is spaced apart from the body section by a gap that receives the walls of the header housing. Further, the header housing may include polarization alignment keys received by the shroud.

At least one embodiment of the present invention provides a CPA including sides for slidably mounting the CPA in an electrical housing, a first surface joining the sides, and at least one arm mounted proximal to the first surface. The arm includes a latch biasing element for biasing a latch during disengagement of connector housings.

Certain embodiments of the present invention thus provide a CPA and latch for electrical connectors. The CPA, in addition to providing position assurance, also provides a convenient and more controllable means for biasing the latch during disengagement. Little space is required, and cost of production is low. Further, breakage of the latch from over-deflection during disengagement of the connector halves is prevented. The latch may also be prevented from inadvertent deflection during mating of the connector halves.

Figure 1:
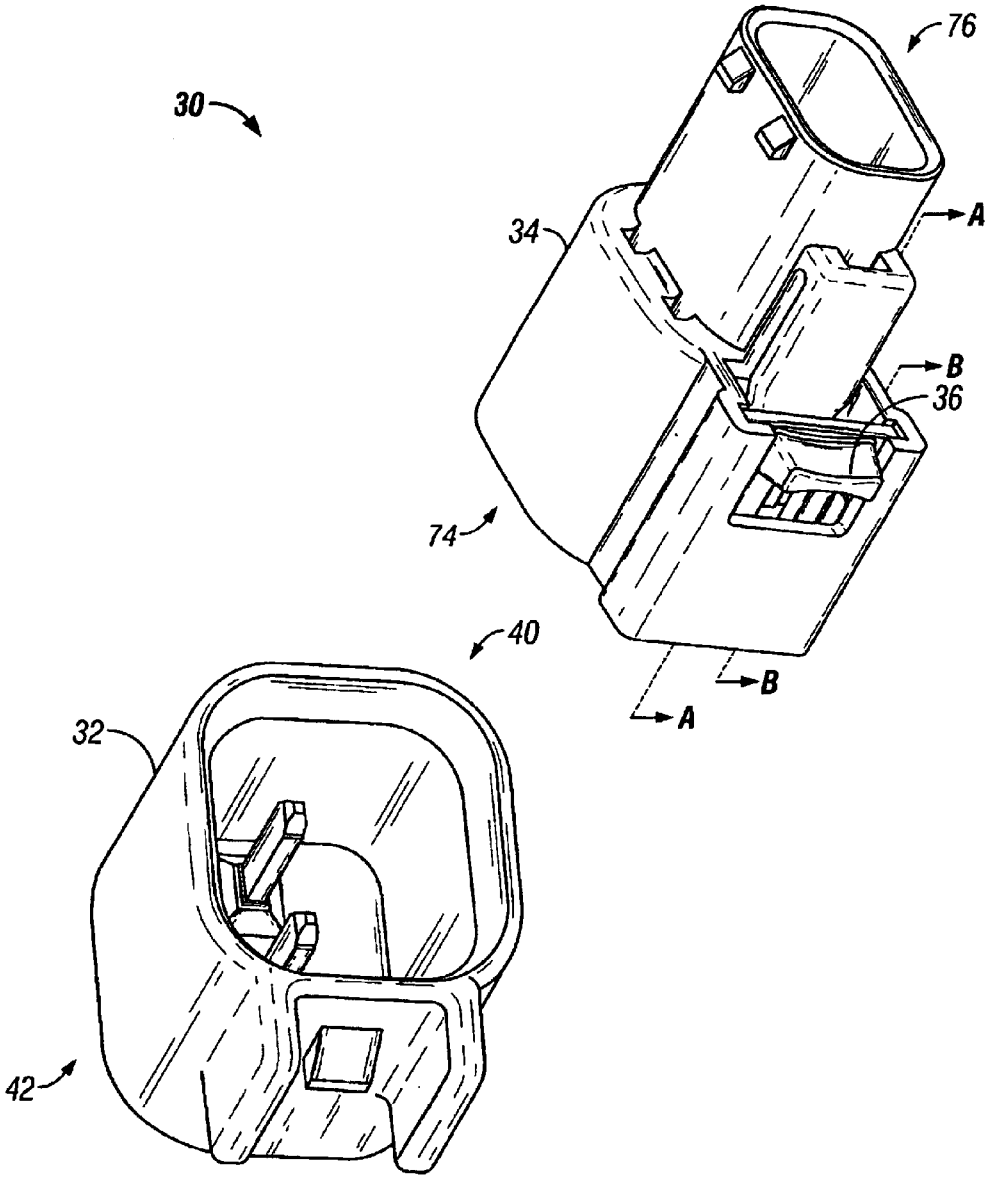
FIG. 1 illustrates an isometric view of a connector assembly formed in accordance with an embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates an isometric view of a connector assembly 30 that comprises a header housing 32 and a plug housing 34. The connector assembly 30 also comprises a connector position assurance device (CPA) 36. The header housing 32 includes a front end 40 and a rear end 42. The rear end 40 of the header housing 32 may receive wires (not shown), and/or be part of another component such as, for example, a fuel injector. The plug housing 34 comprises a front end 74 and a rear end 76. Wires (not shown) may be received by the rear end 76 of the plug housing 34. The front end 74 of the plug housing 34 mates with the front end 40 of the header housing 32, thereby providing electrical communication therebetween. The CPA 36 indicates if the plug housing 34 and the header-housing 32 are mated.

Figure 2:
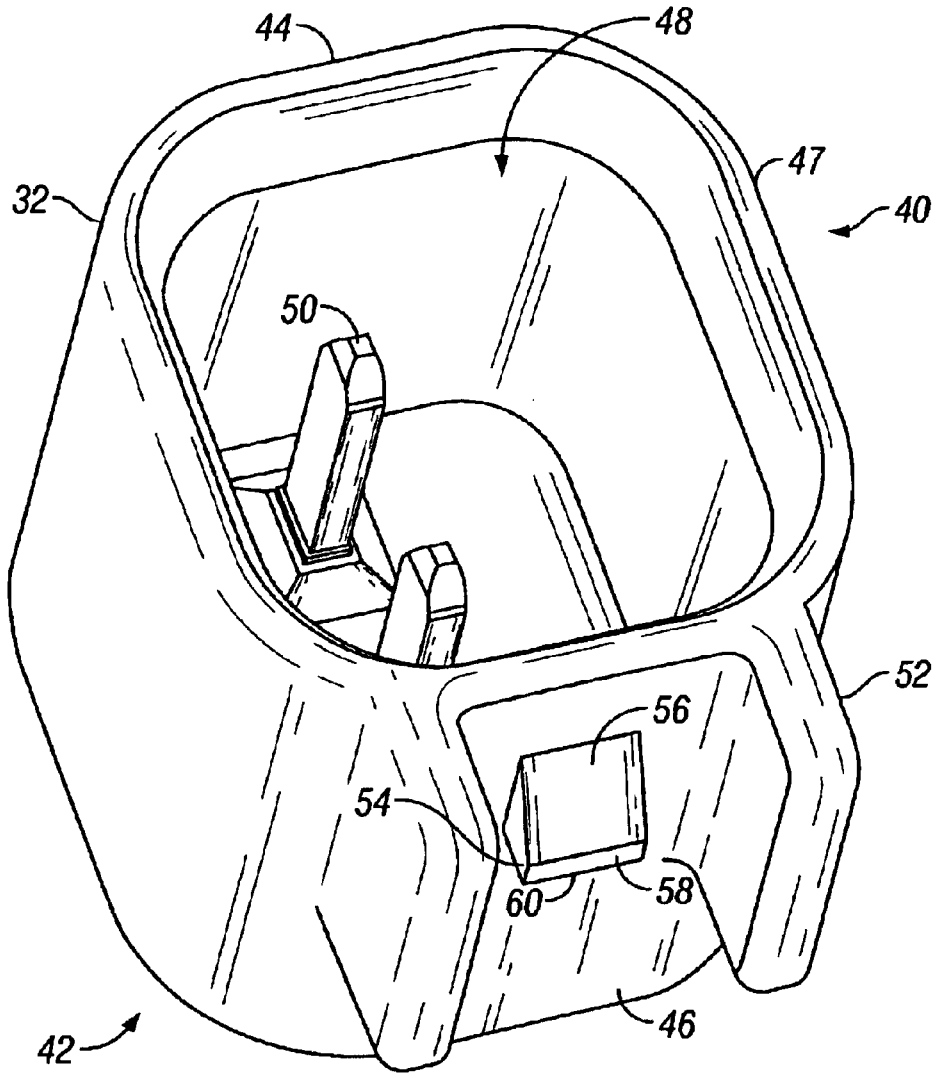
FIG. 2 illustrates an isometric view of a header housing formed in accordance with an embodiment of the present invention.

FIG. 2 illustrates an isometric view of a header housing 32 as viewed from the front end 40 of the header housing 32. The header housing 32 includes a top portion 44, a bottom portion 46, and walls 47. An opening 48 is defined by the interior surfaces of the walls 47 at the front end 40 of the header housing 32. The opening 48 receives the mating interface of the plug housing 34. Inside the opening 48, pins 50 extend toward the front end 40. The illustrated embodiment is designed for use with a two-position connector, and has two pins 50.

The header housing 32 also includes polarization alignment keys 52 extending from the bottom portion 46 proximal to the front end 40. The polarization alignment keys 52 are used to assure that the header housing 32 is properly aligned with the mating plug housing 34.

Further, the header housing 32 includes a latch bump 54. The latch bump 54 extends from the bottom portion 46 of the header housing 32 and comprises a sloped surface 56, a flat surface 58, and a retaining surface 60. The sloped surface 56 extends generally downward from the bottom portion 46 as it extends from the front end 40 to the rear end 42. The sloped surface 56 terminates at the flat surface 58 leading to the retaining surface 60. The retaining surface 60 extends generally perpendicularly from the bottom portion 46 and faces the rear end 42.

Figure 3:
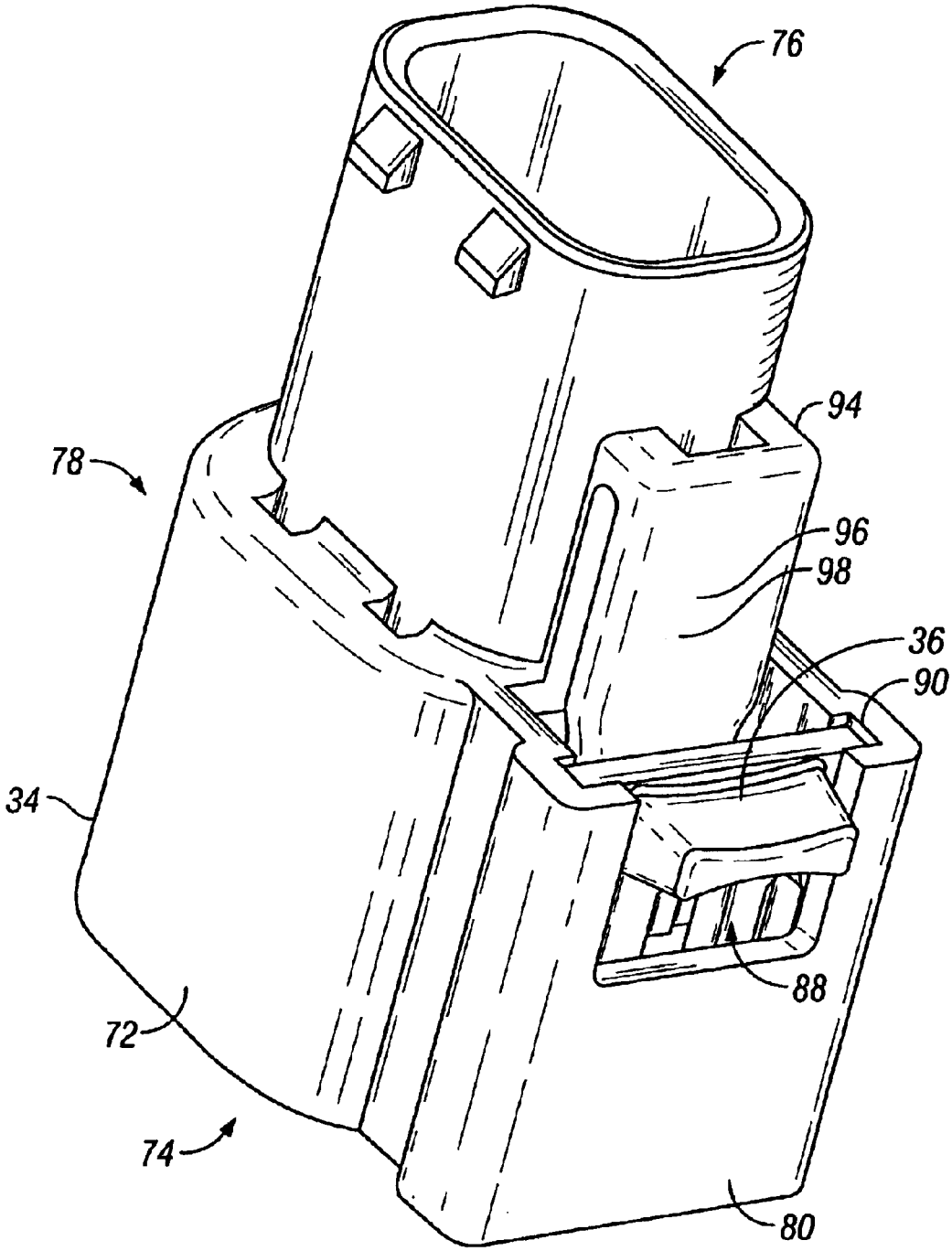
FIG. 3 illustrates an isometric view of a plug housing with a CPA formed in accordance with an embodiment of the present invention.
Figure 4:
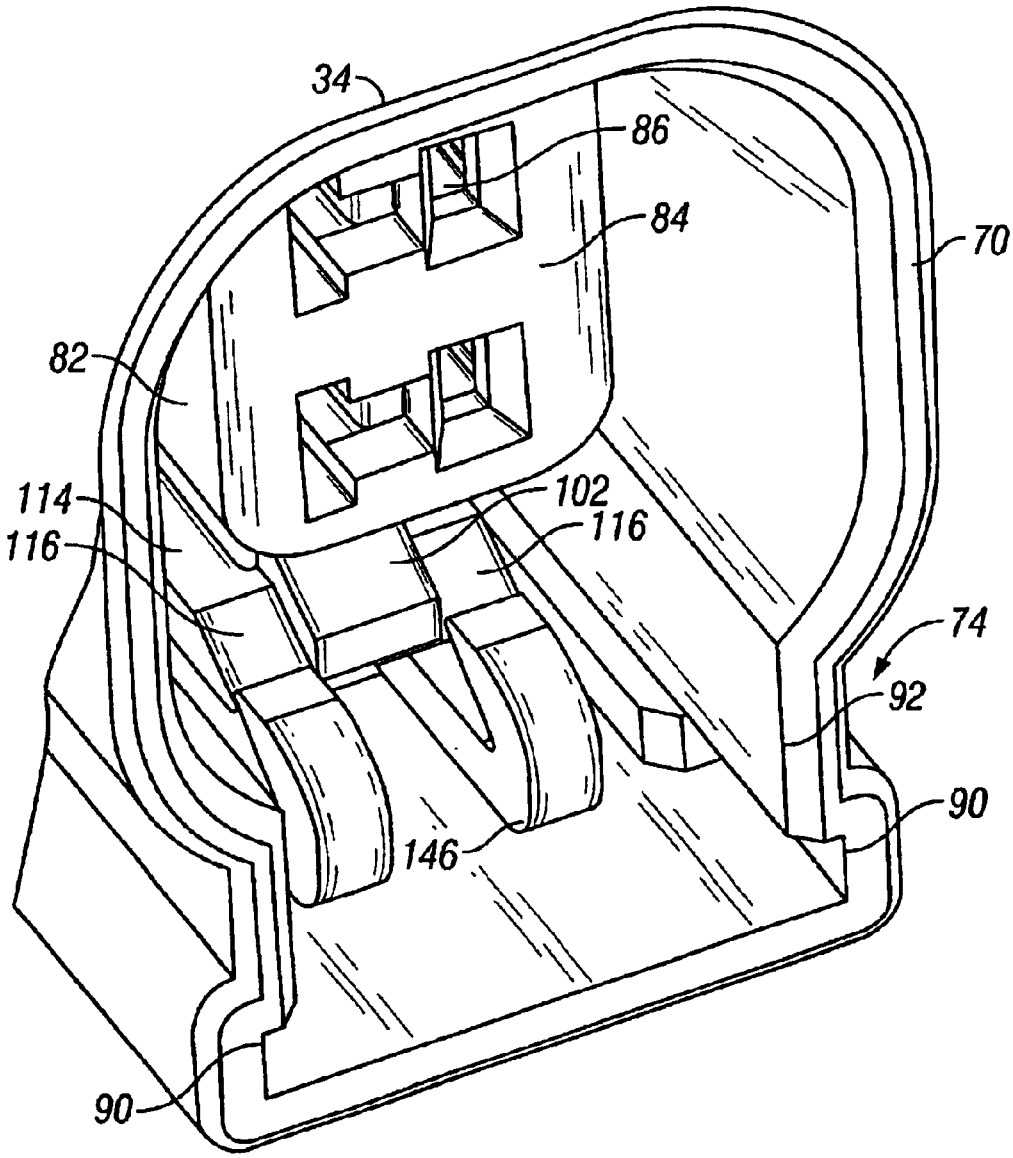
FIG. 4 illustrates a blown up isometric view of a plug housing with a CPA formed in accordance with an embodiment of the present invention.
Figure 5:
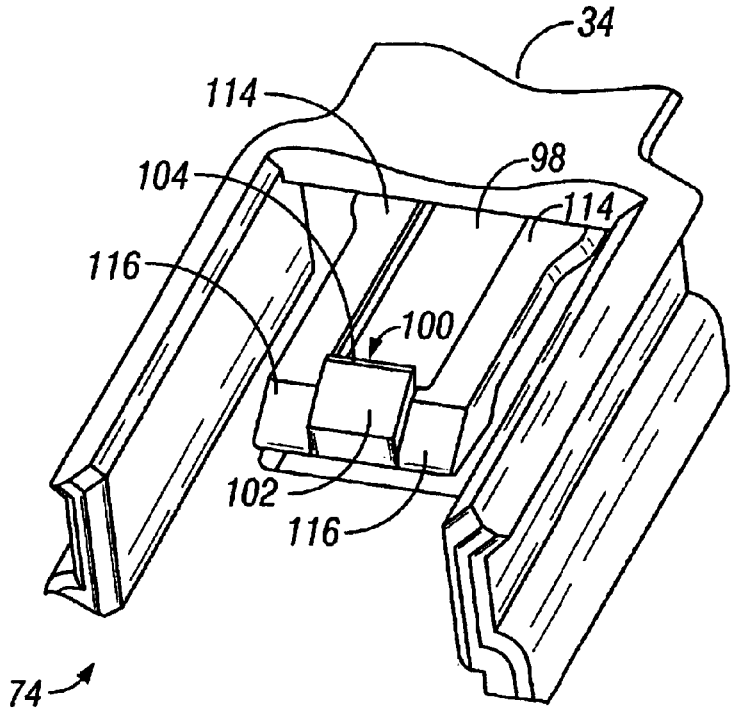
FIG. 5 illustrates a top isometric cutaway view of the plug housing in accordance with an embodiment of the present invention.
Figure 6:
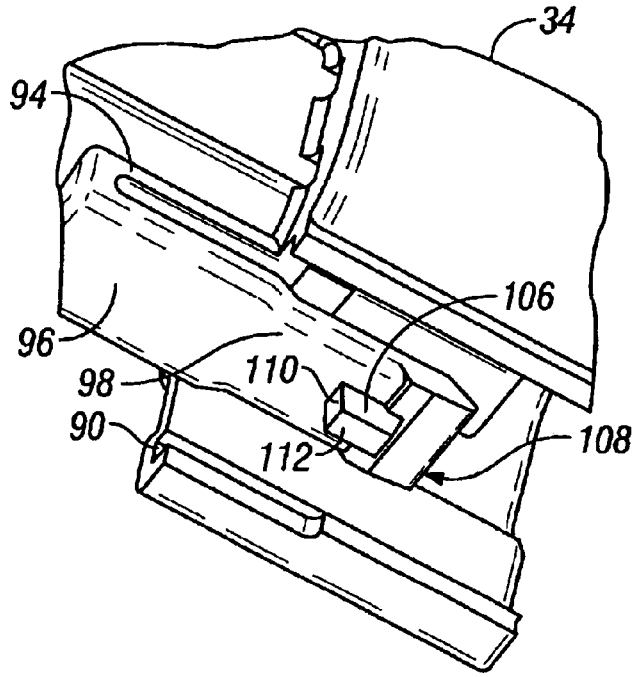
FIG. 6 illustrates a bottom isometric view of the plug housing in accordance with an embodiment of the present invention.

FIG. 3 illustrates an isometric view of the plug housing 34 with the CPA 36 viewed from the rear end 76 of the plug housing 34. FIG. 4 illustrates a blown up isometric view of the plug housing 34 with the CPA 36 from the front end 74 of the plug housing 34. FIG. 5 illustrates a blown up cutaway isometric view from the top of the plug housing 34 with the CPA 36 removed, and FIG. 6 illustrates a blown up isometric view from the bottom of the plug housing 34 with the CPA 36 removed. The plug housing includes sides 72, a front end 74, a rear end 76, a top portion 78, and a bottom portion 80. The sides 72 join the top portion 78 and bottom portion 80.

As shown in FIG. 4, the plug housing 34 includes a shroud 70 surrounding an internal body section 82. A gap separates the shroud 70 and the body section 82. When the plug housing 34 and the header housing 32 are mated, the gap between the shroud 70 and the body section 82 receives the header housing 32. The body section 82 includes a mating interface 84 having receptacles 86. The mating interface 84 is received by the opening 48 of the header housing 32 when the plug housing 34 and the header housing 32 are mated, and the receptacles 86 receive the pins 50.

The bottom portion 80 of the plug housing 34 includes a CPA opening 88 better seen in FIG. 3. Proximal to the CPA opening 88, the plug housing includes a CPA slot 90 sized to slidably receive the CPA 36. The CPA slot may also include detents and/or embossments (not Shown) to retain the CPA 36 within the CPA slot 90, as known in the art. With reference again to FIG. 4, the plug housing includes a key slot 92 sized to accept the polarization alignment keys 52 to assure proper alignment between the header housing 32 and the plug housing 34 when mated.

The plug housing 32 further comprises a latch assembly 94 to retain the plug housing 32 and header housing 34 together when mated to one another. The latch assembly 94 comprises a latch beam 96, a central portion 98, a latching surface 100, a sloped surface 102, an intermediate surface 104, a protrusion 106, and removal arms 114. The latch beam 96 is a cantilever beam extending along the central portion 98 of the latch assembly 94. The latch beam 96 is anchored at a point proximate the middle of the plug housing 32, and extends generally from the rear end 76 to the front end 74 of the plug housing 34. The free end of the latch beam 96 includes the latching surface 100, the sloped surface 102, and the intermediate surface 104. The latch beam 96 is normally aligned in a substantially horizontal position (parallel to the bottom of the plug housing 34), but may be deflected under an imposed force.

As shown in FIG. 5, the sloped surface 102 is located toward the free end of the central portion 98 along the latch beam 96, and extends away from the latch beam 96 (away from the bottom portion 80 toward the top portion 78 of the plug housing 34) and toward the anchored end of the latch beam 96. The sloped surface 102 terminates at the intermediate surface 104, which is joined to the latching surface 100. The latching surface 100 extends from the edge of the intermediate surface 104 back toward the latch beam 96, and is generally perpendicular to the latch beam 96.

Removal arms 114 extend on either side of the central portion 98 along the length of the latch beam 96 and terminate in hooking surfaces 116 proximate to the free end of the latch beam 96. The removal arms 114 are integral to the latch beam 96, and the latch beam 96 is deflected when the removal arms 114 are biased. The hooking surfaces 116 are sloped surfaces extending from the free end of the latch beam 96 away from the bottom portion 80 toward the top portion 78 of the plug housing 34 and toward the anchored end of the latch beam 96. The hooking surfaces 116 cooperate with a latch biasing element of the CPA 36 to deflect the latch assembly 94, allowing disengagement of the header housing 32 and the plug housing 34.

FIG. 6 illustrates an isometric bottom view of the plug housing 34. The latch beam 96 comprises a protrusion 106. Extending from a point along the central portion 98 of the latch beam 96 near the free end of the latch beam 96, the protrusion includes a front 108, a back 110, and a bottom 112. The bottom 112 of the protrusion 106 is generally parallel to the latch beam 96.

Figure 7:
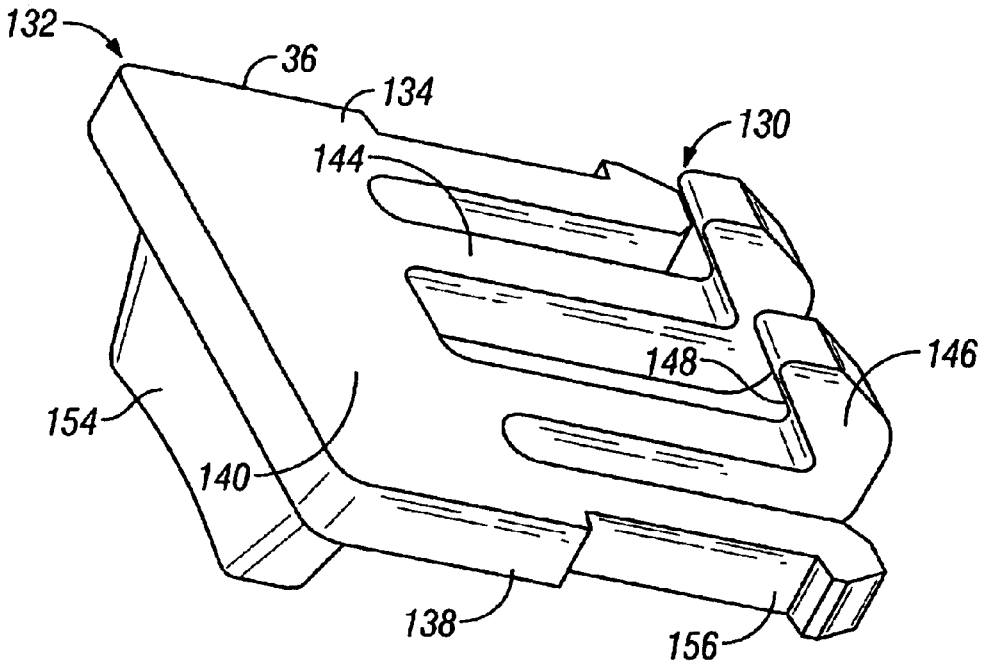
FIG. 7 illustrates a top isometric view of a CPA assembly in accordance with an embodiment of the present invention.
Figure 8:
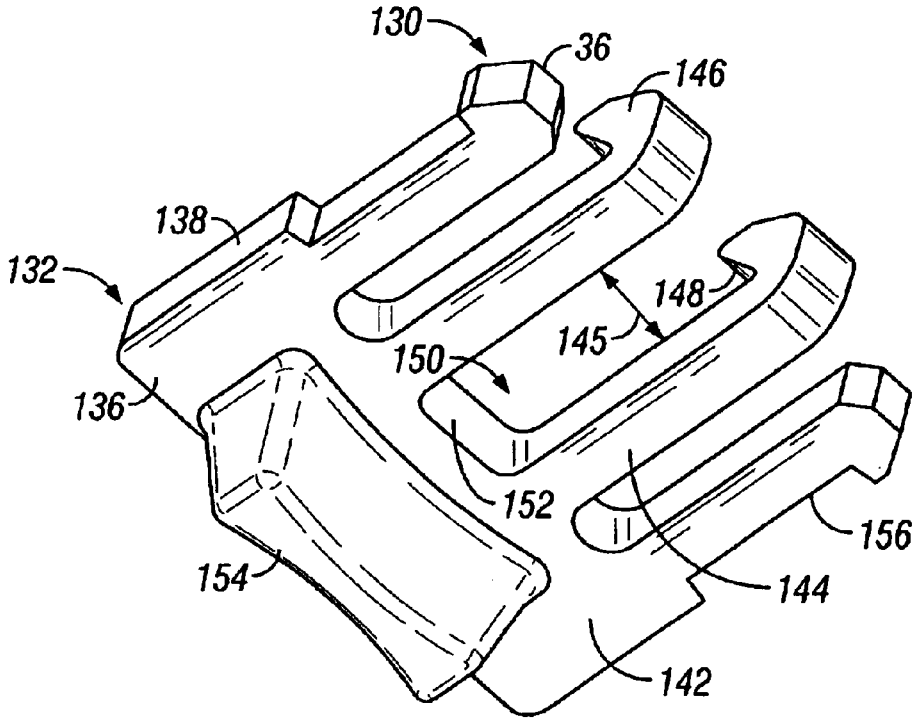
FIG. 8 illustrates a bottom isometric view of a CPA assembly in accordance with an embodiment of the present invention.

FIGS. 7 and 8 illustrate top and bottom isometric views of the CPA 36, respectively. The CPA 36 includes a front end 130, a rear end 132, a top portion 134, a bottom portion 136, and sides 138. The sides 138 are sized to be slidably accepted by the CPA slot 90 of the plug housing 34. The sides 138 may further include channels 156 that cooperate with detents and/or embossments (not shown) on the CPA slot 90 to position and maintain the CPA 36 in place in the CPA slot 90. The top portion 134 includes a top blocking surface 140, and the bottom portion 136 includes a bottom blocking surface 142.

The CPA 36 includes hook arms 144 extending toward the front end 130 of the CPA 136 and spaced apart by a space 145. The hook arms 144 include hooks 146 that extend upward from the top portion 134 near the front end 130 of the CPA 36. The hooks 146 include interior surfaces 148 that accept the hooking surface 116 of the latch assembly 94. The space 145 and the back surface 152 define a central opening 150 large enough to allow the protrusion 106 through when the latch beam 96 is deflected and the CPA 36 is in an appropriate position, with the central opening 150 positioned beneath the protrusion 106. Further, the CPA 36 includes a finger rest 154 to allow an operator to position the CPA 36 using a finger or thumb.

The mating and unmating of the plug housing 34 and the header housing 32 will be described with reference to FIGS. 9–24. The CPA 36 is slidably mounted in the CPA slot 90 with the front end 130 of the CPA 36 oriented toward the front end 74 of the plug housing 34 and with the rear end 132 of the CPA 36 oriented toward the rear end 76 of the plug housing 34. To allow the CPA 36 clearance to be slid into the plug housing 34, the latch beam 96 is deflected upward (nearer to the body section 82) until the bottom of the removal arms 114 clear the hooks 146. Once the CPA 36 is advanced with the hooks 146 past the removal arms 114, the latch beam 96 is allowed to snap back to its substantially horizontal position, and the CPA 36 is moved to the position shown in FIG. 9.

Figure 9:
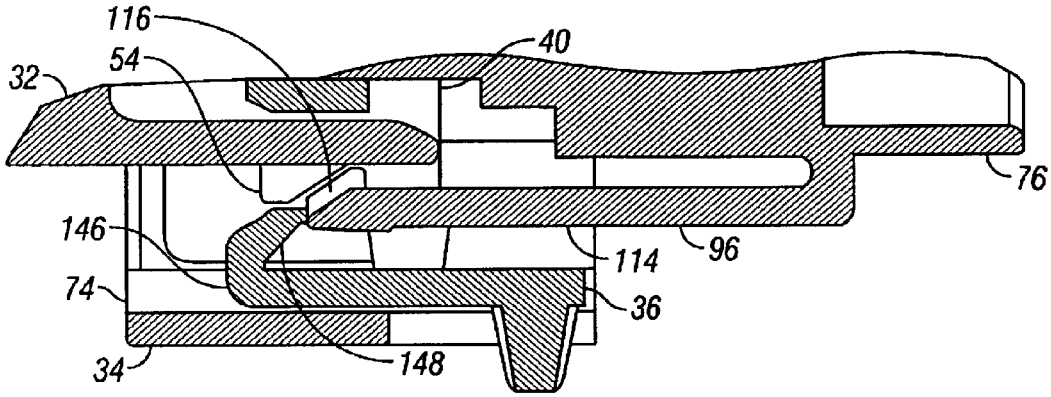
FIG. 9 illustrates a sectional view of a connector assembly at the beginning of the mating process in accordance with an embodiment of the present invention.
Figure 10:
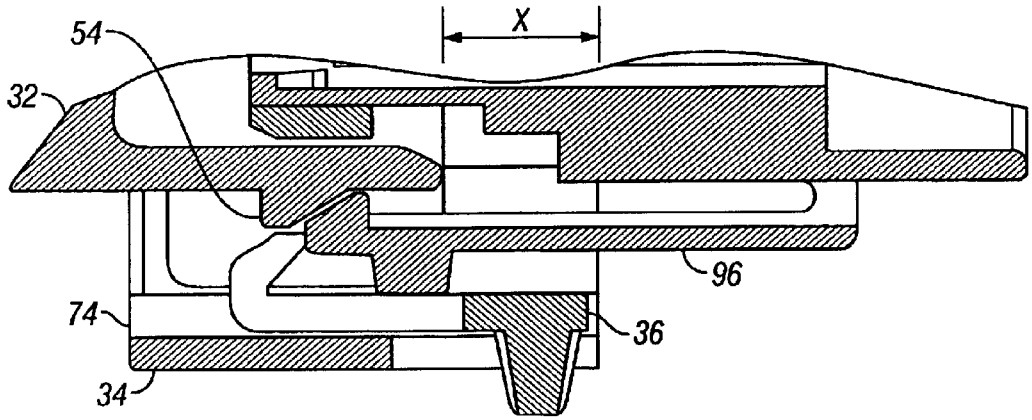
FIG. 10 illustrates a sectional view of a connector assembly at the beginning of the mating process in accordance with an embodiment of the present invention.

With the CPA 36 slidably mounted to the plug housing 34, the header housing 32 and the plug housing 34 may now be mated. FIGS. 9–10 illustrate sectional views of the connector assembly 30 at the beginning of the mating process. FIG. 9 is a section taken along a plane through a removal arm 114, such as line A—A in FIG. 1. FIG. 10 is a section taken along a plane through the central portion 98 of the latch assembly 94, such as line B—B in FIG. 1. The CPA 36 is located in the mate position, toward the rear end 76 of the plug housing 34, but not fully retracted. The front end 74 of the plug housing 34 and the front end 40 of the header housing 32 are brought together such that the polarization alignment keys 52 are aligned with the key slot 92 (see FIGS. 2 and 4). The mating interface 84 is received by the opening 48, and the walls 47 of the header housing 32 are received by the gap between the body section 82 and the shroud 70 of the plug housing 34. With the CPA 36 in the mate position, upward deflection of the latch beam 96 is prevented by contact between the hooking sufaces 116 of the removal arms 114 and the interior surfaces 148 of the hooks 146, thereby preventing any obstacles to mating that could be presented if the latch assembly 94 were inadvertently biased upward. FIGS. 9–10 illustrate the connector assembly 30 at the point where the latch assembly 94 is just about to contact the latch bump 54. In one embodiment at this position, the clearance gap X between the front end 40 of the header housing 32 and a face of the body section 82 of the plug housing 34 is about 4.0 mm, and the latch beam 96 is horizontal.

Figure 11:
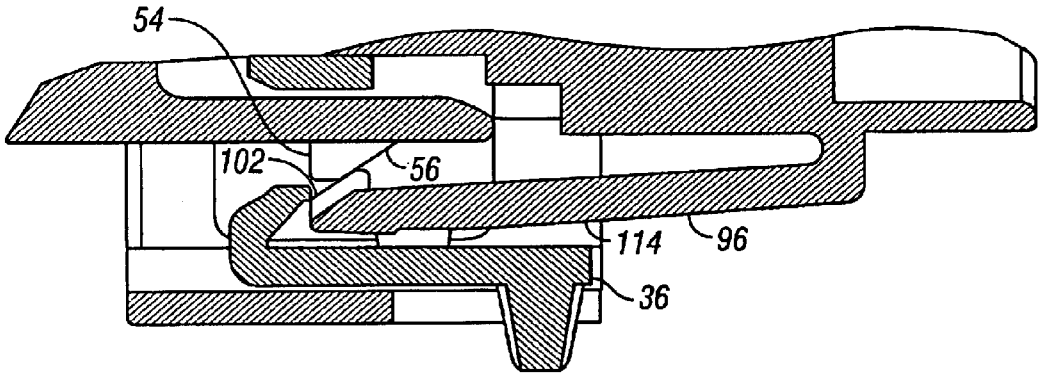
FIG. 11 illustrates a sectional view of a connector assembly as the connector housings are urged toward each other in accordance with an embodiment of the present invention.
Figure 12:
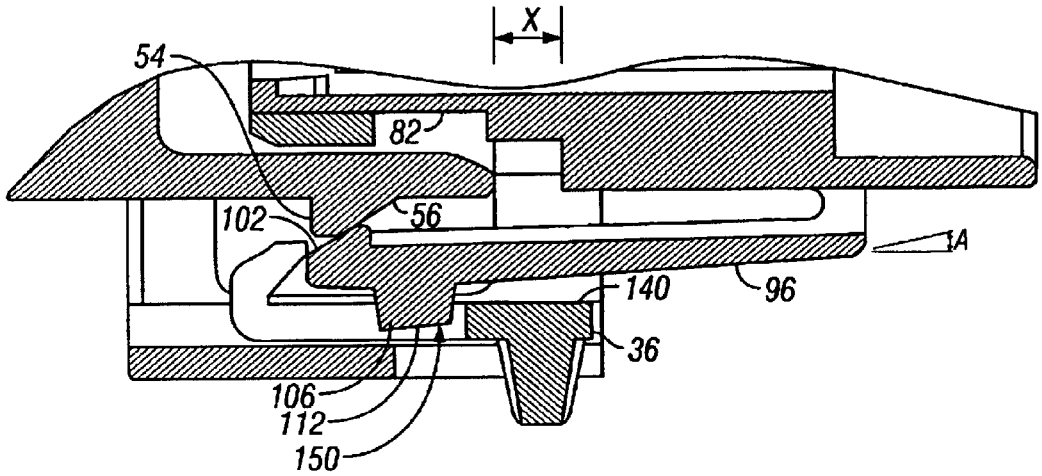
FIG. 12 illustrates a sectional view of a connector assembly as the connector housings are urged toward each other in accordance with an embodiment of the present invention.

FIGS. 11–12 illustrate sectional views of the connector assembly 30 as the housings are urged toward each other.

FIG. 11 is a section taken along a plane through a removal arm 114, such as line A—A in FIG. 1. FIG. 12 is a section taken along a plane through the central portion 98 of the latch assembly 94, such as line B—B in FIG. 1. As the housings are urged together, the sloped surface 102 of the latch assembly 94 encounters the sloped surface 56 of the latch bump 54. As the sloped surfaces of the latch assembly 94 and the latch bump 54 slide along each other, the latch beam 96 is deflected away from the body section 82. As shown in FIG. 12, as the latch beam 96 deflects with the CPA 36 in the mate position, the protrusion 106 extends through the central opening 150. If the CPA 36 were advanced too far past the mate position, however, the bottom 112 of the protrusion 106 would encounter the top blocking surface 140 of the CPA 36, thereby preventing the latch beam 96 from being deflected and, consequently, the housings from being mated. In one embodiment, the angle of deflection A for the latch beam 96 is about 3° from the horizontal when the clearance gap X is about 2.2 mm.

Figure 13:
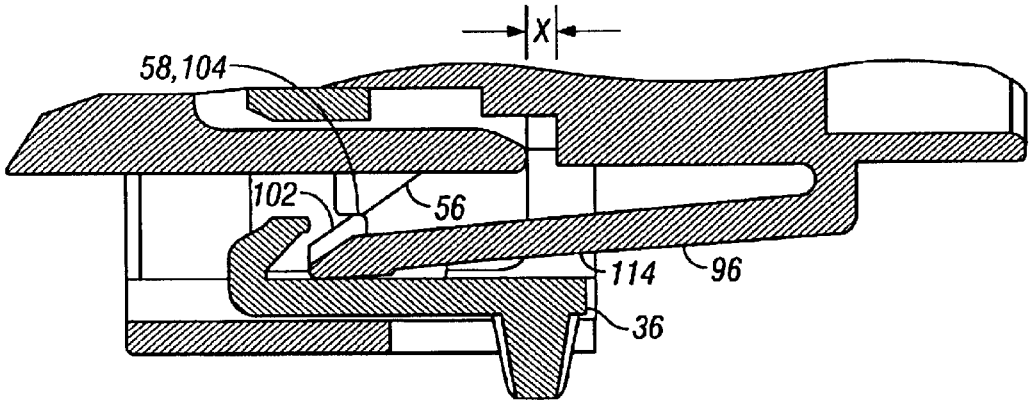
FIG. 13 illustrates a sectional view of a connector assembly as the connector housings are urged further toward each other in accordance with an embodiment of the present invention.
Figure 14:
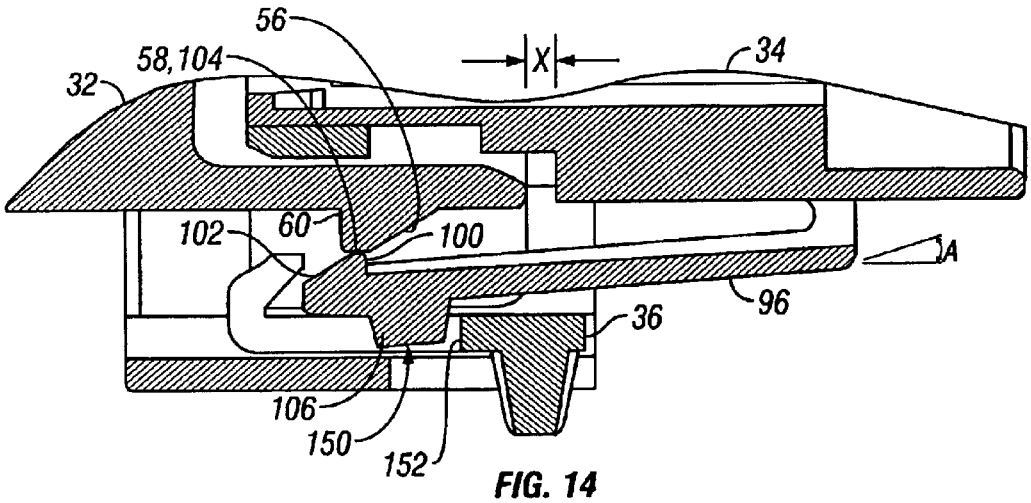
FIG. 14 illustrates a sectional view of a connector assembly as the connector housings are urged further toward each other in accordance with an embodiment of the present invention.

FIGS. 13–14 illustrate sectional views of the connector assembly 30 as the housings are further urged toward each other. FIG. 13 is a section taken along a plane through a removal arm 114, such as line A—A in FIG. 1. FIG. 14 is a section taken along a plane through the central portion 98 of the latch assembly 94, such as line B—B in FIG. 1. The sloped surfaces have slid past each other, and the intermediate surface 104 of the latch assembly 94 is in contact with the flat surface 58 of the latch bump 54, and the latch beam 96 has a greater deflection than at the stage depicted in FIGS. 11–12. In one embodiment, the angle of deflection A is about 4.60 when the clearance gap X is 1.6 mm. The CPA 36 is maintained in the mate position.

Figure 15:
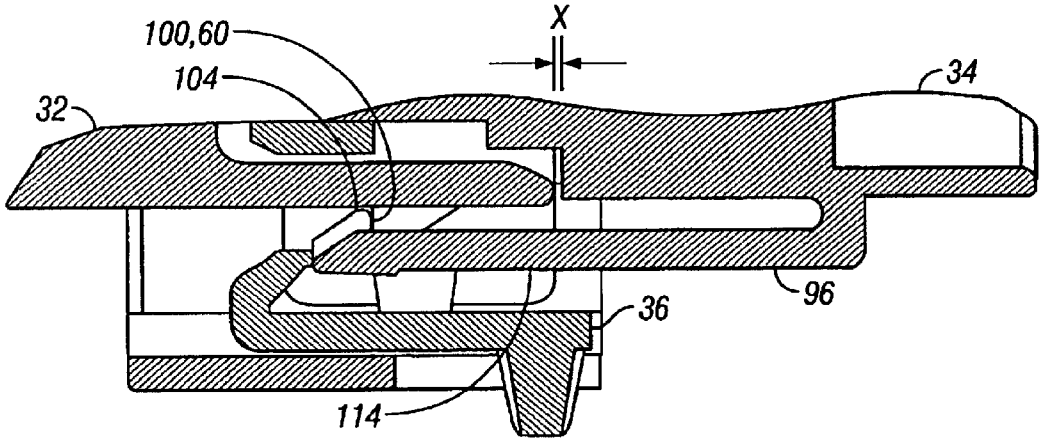
FIG. 15 illustrates a sectional view of a connector assembly with the connector housings mated and the CPA still in the mate position in accordance with an embodiment of the present invention.
Figure 16:
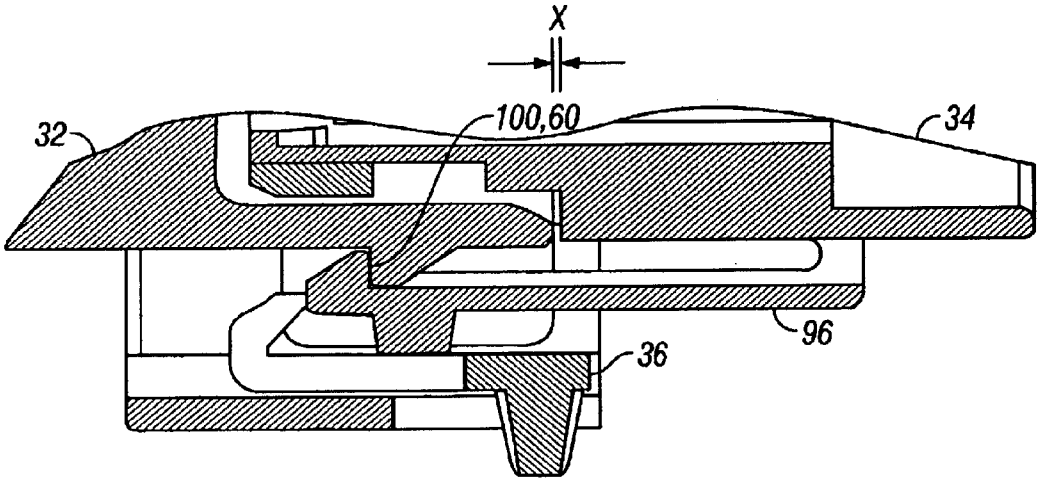
FIG. 16 illustrates a sectional view of a connector assembly with the connector housings mated and the CPA still in the mate position in accordance with an embodiment of the present invention.

FIGS. 15–16 illustrate sectional views of the connector assembly 30 as the housings are still further urged toward each other and mated, with the. CPA 36 maintained in the mate position. FIG. 15 is a section taken along a plane through a removal arm 114, such as line A—A in FIG. 1. FIG. 16 is a section taken along a plane through the central portion 98 of the latch assembly 94, such as line B—B in FIG. 1. The intermediate surface 104 of the latch assembly 94 has slid past the flat surface 58 of the latch bump 54, and the latch beam 96 has returned to a generally horizontal position. At this position, the pins 50 have been accepted by the receptacles 86, and the header housing 32 and the plug housing 34 are fully mated. The latch assembly 94 has snapped back into place and maintains the connector housings together, and is now in its latched, or locked, position. If the connector housings are urged apart, the latching surface 100 of the latch assembly 94 will encounter the retaining surface 60 of the latch bump 54 and prevent the separation of the housings. Thus, for the connectors to be unmated, the latch beam 96 must be deflected. In one embodiment, the clearance gap X is about 0.15 mm when the connectors are mated.

Figure 17:
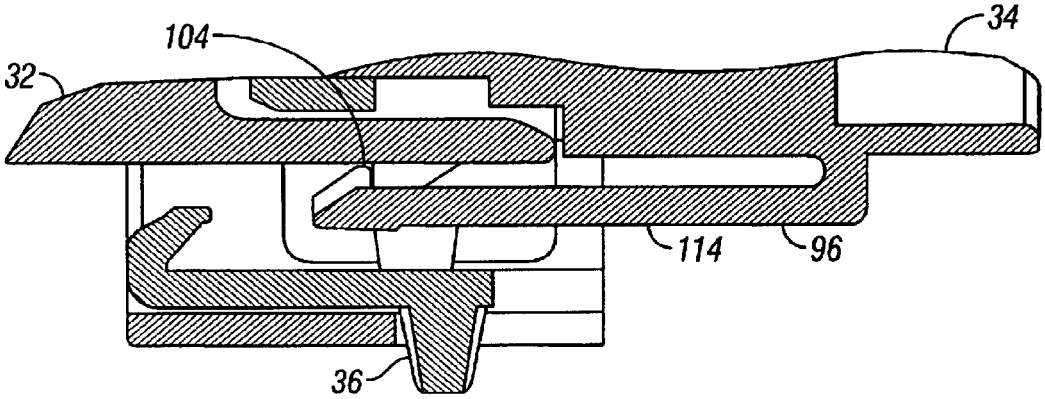
FIG. 17 illustrates a sectional view of a connector assembly with the CPA advanced to a locked position in accordance with an embodiment of the present invention.
Figure 18:
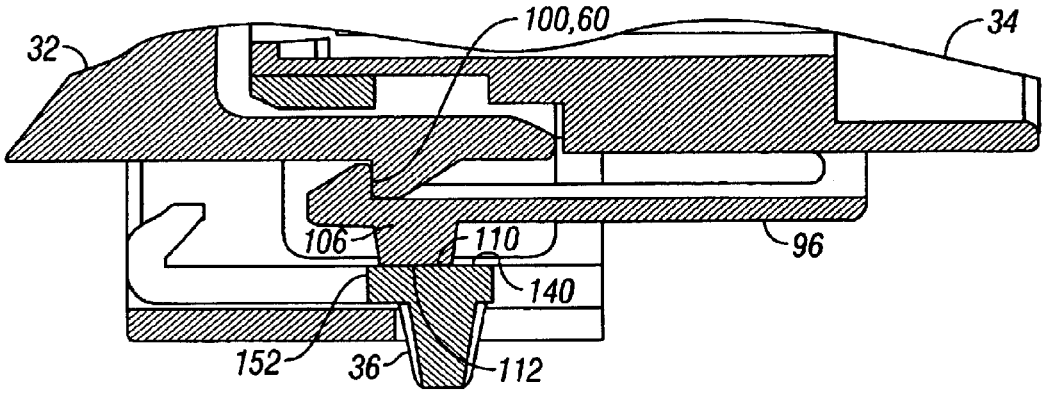
FIG. 18 illustrates a sectional view of a connector assembly with the CPA advanced to a locked position in accordance with an embodiment of the present invention.

FIGS. 17–18 illustrate sectional views of the connector assembly 30 with the header housing 32 and plug housing 34 mated to each other, and the CPA 36 advanced to the locked position. FIG. 17 is a section taken along a plane through a removal arm 114, such as line A—A in FIG. 1. FIG. 18 is a section taken along a plane through the central portion 98 of the latch assembly 94, such as line B—B in FIG. 1. The CPA 36 has been advanced from the mate position depicted in FIGS. 9–16 to the locked position. In one embodiment the CPA 36 is advanced to the locked position about 3.5 mm toward the front end 74 of the plug housing 34 from the mate position illustrated in FIGS. 15–16. With the CPA 36 advanced to the locked position, the top blocking surface 140 of the CPA 36 is directly underneath the protrusion 106. Thus, any attempted downward deflection of the latch beam 96 will be prevented when the bottom 112 of the protrusion 106 encounters the top blocking surface 140 of the CPA 36, and the latch beam 96 will not be deflected. Because the latch beam 96 can not be deflected, the latching surface 100 will encounter the retaining surface 60, and the connector housings will not be unmated. The CPA 36 thus not only indicates that the connector housings are mated, but also helps maintain the connector housings in their mated position.

If the CPA 36 is advanced toward the mated position with the connector housings not fully mated, the CPA 36 will assist in completing the mating process. If the connector housings are only partially mated, the latch beam 96 will still be deflected, and the protrusion 106 will extend into the central opening 150 of the CPA 36 (see FIG. 14). As the CPA 36 is advanced, the back surface 152 of the CPA 36 will encounter the back 110 of the protrusion 106. Further advancing the CPA 36 will thus urge the latch assembly 94 forward until the latching surface 100 passes the retaining surface 60 and mating is complete. Thus the CPA 36, in addition to indicating that the connector housings are mated and locking them in connection, also can be used to assist in mating the connector housings when they are partially mated and the latch assembly 94 is partially deflected.

Figure 19:
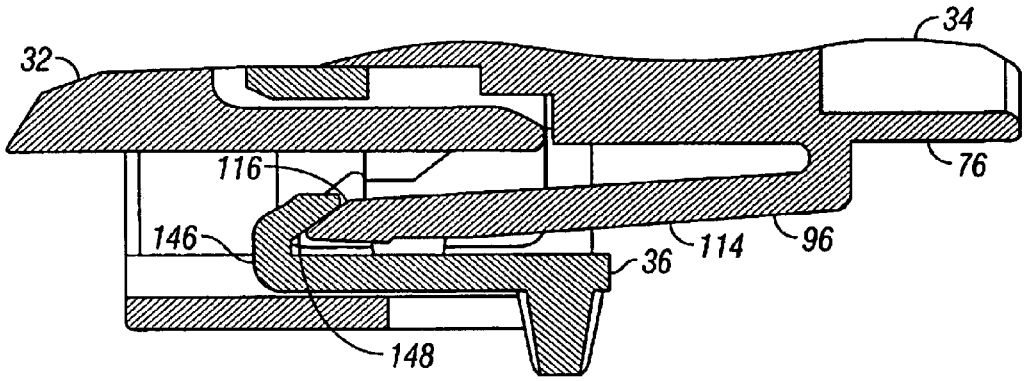
FIG. 19 illustrates a sectional view of a connector assembly with the CPA being retracted toward the unmate position in accordance with an embodiment of the present invention.
Figure 20:
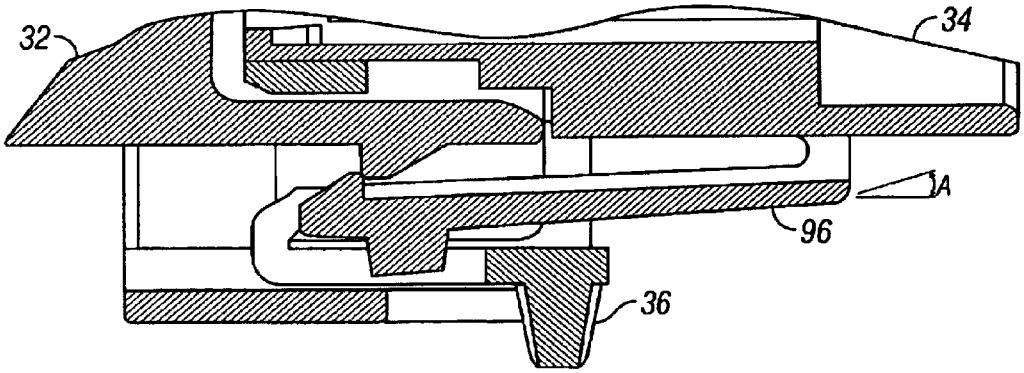
FIG. 20 illustrates a sectional view of a connector assembly with the CPA being retracted toward the unmate position in accordance with an embodiment of the present invention.

FIGS. 19–20 illustrate sectional views of the connector assembly 30 as the housings are still mated, but the CPA 36 is being retracted toward the unmate position. FIG. 19 is a section taken along a plane through a removal arm 114, such as line A—A in FIG. 1. FIG. 20 is a section taken along a plane through the central portion 98 of the latch assembly 94, such as line B—B in FIG. 1. The CPA 36 has been moved toward the rear end 76 of the plug housing 34 from the locked position. As the CPA 36 is moved to the illustrated position, the interior surfaces 148 of the hooks 146 encounter the hooking surfaces 116 of the removal arms 114. Further rearward movement of the CPA 36 causes the hooking surfaces 116 to slide along the interior surfaces 148 of the hooks 146, thereby deflecting the latch beam 96. In one embodiment, the angle A is about 3° when the CPA 36 has been pulled back about 4.5 mm from the locked position illustrated in FIGS. 17–18.

Figure 21:
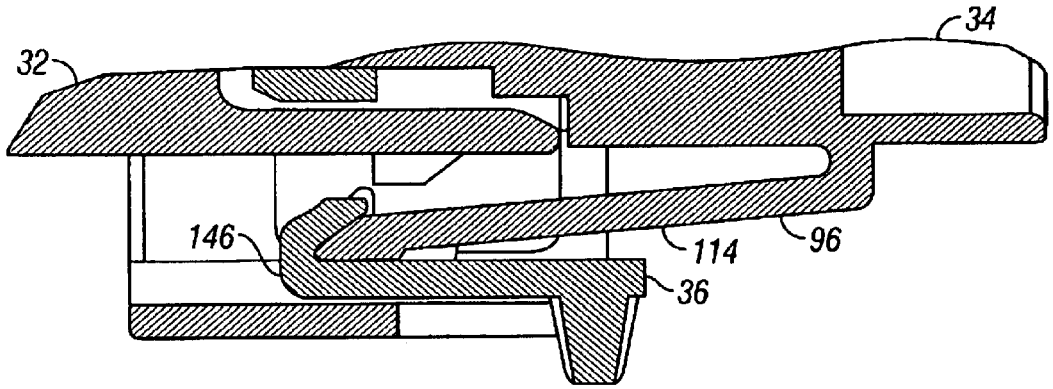
FIG. 21 illustrates a sectional view of a connector assembly with the CPA in the unmate position in accordance with an embodiment of the present invention.
Figure 22:
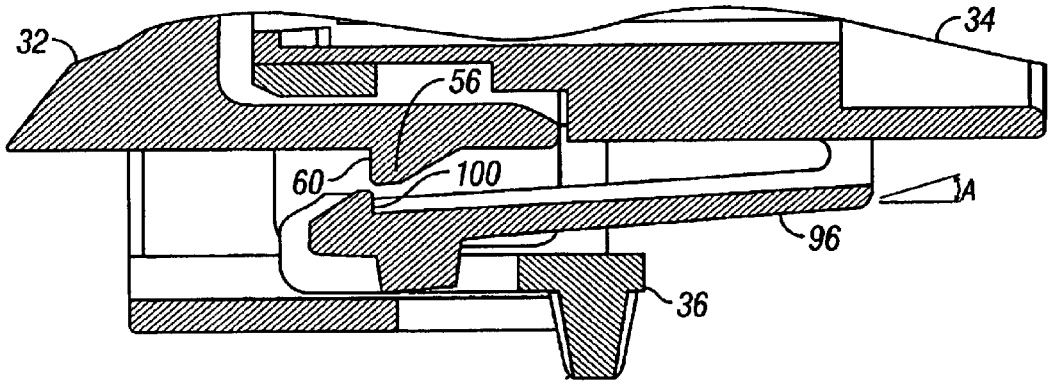
FIG. 22 illustrates a sectional view of a connector assembly with the CPA in the unmate position in accordance with an embodiment of the present invention.

FIGS. 21–22 illustrate sectional views of the connector assembly 30 as the housings are still mated, but the CPA 36 is in the unmate position. FIG. 21 is a section taken along a plane through a removal arm 114, such as line A—A in FIG. 1. FIG. 22 is a section taken along a plane through the central portion 98 of the latch assembly 94, such as line B—B in FIG. 1. The CPA 36 has been moved further toward the rear end 76 of the plug housing 34 from the position illustrated in FIGS. 19–20. As the CPA 36 is further moved rearward, the hooking surfaces 116 slide further along the interior surfaces 148 of the hooks 146, thereby further deflecting the latch beam 96, until the latching surface 100 of the latch assembly 94 has left contact with the retaining surface 60 of the latch bump 56. With the latching surface 100 clear of the retaining surface 60, the latch assembly 94 is in the unlocked or unlatched position, and the connector housings may be separated. The interaction of the removal arms 114 and the hooks 146 allow the CPA 36 to provide control over the amount of deflection of the latch beam 96 during the movement from the latched to the unlatched position. In one embodiment, the angle A is about 5° when the CPA 36 in its unmate position has been pulled back about 5.25 mm from the locked position illustrated in FIGS. 17–18.

Figure 23:
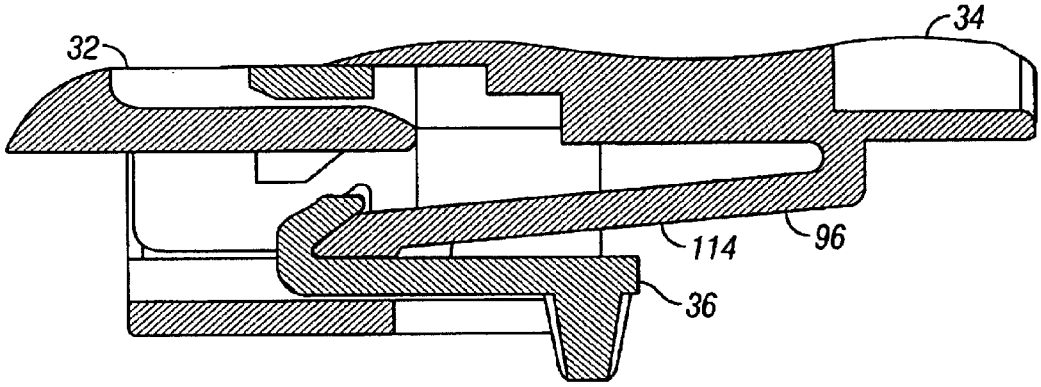
FIG. 23 illustrates a sectional view of a connector assembly with the CPA in the unmate position as the connector housings are urged apart in accordance with an embodiment of the present invention.
Figure 24:
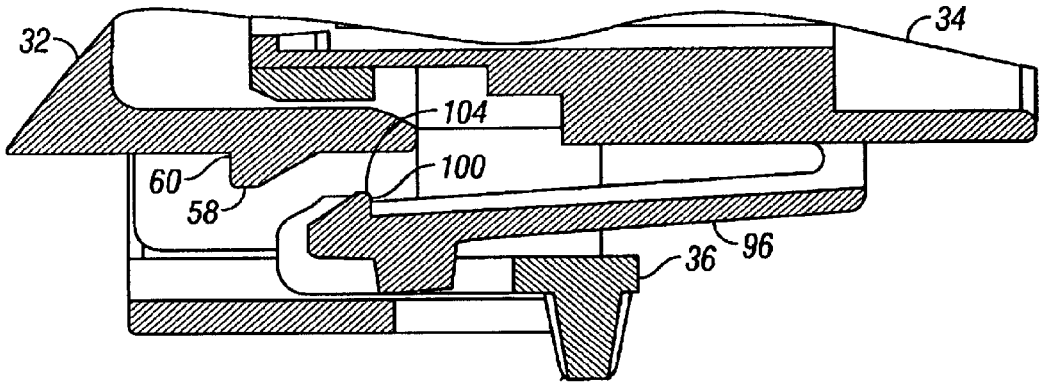
FIG. 24 illustrates a sectional view of a connector assembly with the CPA in the unmate position as the connector housings are urged apart in accordance with an embodiment of the present invention.

FIGS. 23–24 illustrate sectional views of the connector assembly 30 with the CPA 36 in the unmate position as the connector housings are unmated. FIG. 23 is a section taken along a plane through a removal arm 114, such as line A—A in FIG. 1. FIG. 24 is a section taken along a plane through the central portion 98 of the latch assembly 94, such as line B—B in FIG. 1. Because the latching surface 100 is clear of the retaining surface 60 with the CPA 36 in the unmate position, the connector housings could be separated. When the intermediate surface 104 of the latch assembly 94 is past the flat surface 58 of the latch bump 54 and the connector housings have been separated, the CPA 36 may be released from the unmate position, at which point the latch beam 96 will return to its unbiased generally horizontal position, and the CPA 36 will be returned to the mate position. Thus, as described above, the CPA 36, in addition to providing position assurance, cooperates with the latch assembly 94 during the mating and unmating of the connector housings, providing greater control during disengagement, and making disengagement more convenient. This cooperation allows for a space-saving design with convenient operation. Further, the use of the CPA 36 provides control of the deflection of the latch beam 96, protecting against deflecting the latch beam 96 too far, which would result in breaking the latch beam 96.

While particular elements, embodiments and applications of the present invention have been shown and described, it will be understood, of course, that the invention is not limited thereto since modifications may be made by those skilled in the art, particularly in light of the foregoing teachings. For example, the header could be a wire-side male cap. Also, the plug and header housings could be reversed, with, for example, the CPA mounted to the header housing. It is therefore contemplated by the appended claims to cover such modifications as incorporate those features which come within the spirit and scope of the invention.

What is claimed is:

1. An electrical connector assembly comprising:

a connector position assurance device (CPA) including a retention assembly biasing element;

a first connector housing having a body section with a mating interface on one end thereof;

a second connector housing having an opening to receive said mating interface;

a retention assembly mounted to at least one of said first and second connector housings for maintaining contact between said first and second connector housings when mated, said retention assembly including a removal element, said retention assembly being movable between locked and unlocked positions in response to contact between said removal element and said retention assembly biasing element; and a CPA mounted to at least one of said first and second connector housings, said CPA being slidably mounted and movable to first, second, and third positions, said CPA permitting engagement of said first and second connector housings when in said first position, said CPA preventing disengagement of said first and second connector housings when in said second position, said CPA biasing at least a part of said retention assembly to permit disengagement of said first and second connector housings when in said third position.

2. The electrical connector assembly of claim 1 wherein said retention assembly includes an arm, and said retention assembly biasing element includes a hook configured to accept said arm.

3. The electrical connector assembly of claim 1 wherein said retention assembly includes a cantilever beam that is unbiased when said retention assembly is in said locked position and deflected when said retention assembly is in said unlocked position.

4. The electrical connector assembly of claim 1 wherein said CPA includes a mating facilitation surface contacting said retention assembly and urging said first and second connector housings into contact when said retention assembly is in said unlocked position and said CPA is located at a fourth position between said first and second positions.

5. The electrical connector assembly of claim 1 wherein said at least one of said first and second connector housings includes a slot, and said CPA includes sides slidably received in said slot.

6. The electrical connector assembly of claim 1 wherein said CPA and said retention assembly are both mounted to one of said first and second connector housings.

7. The electrical connector assembly of claim 1 wherein said CPA includes a finger rest for urging said CPA between said first, second, and third positions.

8. The electrical connector assembly of claim 1 wherein said removal element contacts said retention assembly biasing element such that said CPA moves from said third position to said first position when said retention assembly moves from said unlocked position to said locked position.

9. The electrical connector assembly of claim 1 wherein said retention assembly biasing element engages said removal element and limits the biasing of said retention assembly during disengagement of said first and second connector housings.

10. The electrical connector assembly of claim 1 wherein, when said CPA is moved from said second position to said third position and said first and second connector housings are being disengaged, said CPA travels in the same direction that one of said first and second connector housing travels from the other said connector housing.

11. An electrical connector comprising:

a connector position assurance device (CPA) including a latch biasing element;

a plug housing having a body section with a mating interface on one end thereof, said mating interface including at least one receptacle;

a header housing including walls defining an opening to receive said mating interface, and at least one pin to mate with said at least one receptacle;

a latch mounted to at least one of said plug and header housings for maintaining said plug and header housings in contact when mated, said latch including a latching surface and a removal feature, one end of said latch deflectably movable between a latched position and an unlatched position responsive to contact between said removal feature and said latch biasing element;

a CPA mounted to at least one of said plug and header housings, said CPA being slidably mounted and movable to mate, locked, and unmate positions, said CPA permitting engagement of said plug and header housings when in said mate position, said CPA preventing disengagement of said plug and header housings when in said locked position, said CPA deflecting at least part of said latch and moving said latch to said unlatched position, thereby permitting disengagement of said plug and header housings when said CPA is in said unmate position.

12. The electrical connector of claim 11 wherein said latch includes a removal arm, and said latch biasing element includes a hook configured to accept said removal arm.

13. The electrical connector of claim 11 wherein said CPA includes a mating facilitation surface, wherein, when said latch is in said unlatched position and said CPA is located at an intermediate position between said mate and locked positions, said mating facilitation surface contacts said latch and urges said plug and header housings into contact.

14. The electrical connector of claim 11 wherein said plug housing includes a shroud extending about at least a portion of said body section, said shroud being spaced apart from said body section by a gap, said walls of said header housing being received in said gap between said shroud and said body section.

15. The electrical connector of claim 14 wherein said header housing includes polarization alignment keys received by said shroud.

16. The electrical connector of claim 11 wherein at least one of said plug housing and said header housing includes a slot, and said CPA includes sides slidably received in said slot.

17. The electrical connector of claim 11 wherein said CPA and said latch are mounted to the same housing.

18. The electrical connector of claim 11 wherein said CPA includes a finger rest for urging said CPA between said mate, locked, and unmate positions.

19. A connector position assurance device (CPA) for mating electrical connector housings comprising:

sides for slidably mounting said CPA in an electrical housing;

a first surface joining said sides;

at least one arm mounted proximal to said first surface including a latch biasing element for biasing a latch during disengagement of electrical connector housings; and an opening proximal to said at least one arm and said first surface, and a mating facilitation surface for urging electrical connectors together during mating, said mating facilitation surface extending generally perpendicular from said first surface.

20. The CPA of claim 19 wherein said latch biasing element includes a hook.

21. The CPA of claim 19 further comprising a second surface opposite said first surface, and a finger rest for positioning said CPA, said finger rest extending from said second surface.

22. A connector position assurance device (CPA) for mating electrical connector housings comprising:

sides for slidably mounting said CPA in an electrical housing;

a first surface joining said sides;

at least one arm mounted proximal to said first surface including a latch biasing element for biasing a latch during disengagement of electrical connector housings; and a second surface opposite said first surface, and a finger rest for positioning said CPA, said finger rest extending from said second surface.

* * * * *